United States Patent [19]

Urban

[11] Patent Number: 4,988,052

[45] Date of Patent: Jan. 29, 1991

[54] DEVICE FOR WINDING LONGITUDINALLY SEPARATED WEBS AND METHOD OF CHANGING FINISHED REELS AND EMPTY CORES

[75] Inventor: Ernst-Günther Urban, Buchenweg, Fed. Rep. of Germany

[73] Assignee: Jagenberg Aktiengesellshaft, Dusseldorf, Fed. Rep. of Germany

[21] Appl. No.: 861,624

[22] Filed: May 7, 1986

Related U.S. Application Data

[63] Continuation of Ser. No. 586,939, Mar. 7, 1984, abandoned.

[30] Foreign Application Priority Data

Mar. 9, 1983 [DE] Fed. Rep. of Germany ..... 3308271

[51] Int. Cl.[5] ..... B65H 19/26; B65H 19/30

[52] U.S. Cl. ..... 242/56.4; 242/56.6; 242/65

[58] Field of Search ..... 242/56 R, 56.4, 56.6, 242/65, 66, 79

[56] References Cited

U.S. PATENT DOCUMENTS

| | | | |
|---|---|---|---|
| 2,915,255 | 12/1959 | Phelps | 242/56 R |
| 2,984,427 | 5/1961 | Rockstrom | 242/65 |
| 3,332,636 | 7/1967 | Rockstrom et al. | 242/65 |
| 3,383,064 | 5/1968 | Daly et al. | 242/66 X |
| 3,792,820 | 2/1974 | Lucas | 242/67.3 R X |
| 3,841,578 | 10/1974 | Dorfel | 242/66 |
| 3,869,095 | 3/1975 | Diltz | 242/66 |
| 3,877,654 | 4/1975 | Randpalu et al. | 242/65 |
| 3,929,299 | 12/1975 | Walkington | 242/65 |
| 3,944,152 | 3/1976 | Heymanns | 242/65 |
| 3,949,948 | 4/1976 | Tomma | 242/65 X |
| 4,049,212 | 9/1977 | Yamaguchi et al. | 242/65 X |
| 4,111,377 | 9/1978 | Tetro et al. | 242/65 X |
| 4,133,495 | 1/1979 | Dowd | 242/66 |
| 4,368,855 | 1/1983 | Schönmeier et al. | 242/66 X |
| 4,408,727 | 10/1983 | Dropczynski | 242/66 X |
| 4,444,360 | 4/1984 | Kaipf et al. | 242/66 X |
| 4,458,853 | 7/1984 | Heymanns | 242/66 X |

FOREIGN PATENT DOCUMENTS 2091226 7/1982 United Kingdom .

*Primary Examiner*—John M. Jillions

*Attorney, Agent, or Firm*—Sprung, Horn, Kramer & Woods

[57] ABSTRACT

A device for winding longitudinally separated webs, especially paper webs, on reel cores that are mounted alternately on one and on the opposite side of a backing roll in such a way as to rotate on displaceable bearing brackets and that are forced against one generating line of the backing roll. The number of cores is equal to the number of webs. The device is equipped with means for removing the finished reels and with knives for separating the web longitudinally and transversely, an automatic core inserter and a device for applying glue in the vicinity of the cut area of the longitudinally separated web. The device also has transverse knives that extend over the total axial length of the backing roll.

6 Claims, 6 Drawing Sheets

DEVICE FOR WINDING LONGITUDINALLY SEPARATED WEBS AND METHOD OF CHANGING FINISHED REELS AND EMPTY CORES

This application is a continuation of application Ser. No. 586,939, filed March 7, 1984, now abandoned.

BACKGROUND OF THE INVENTION

The present invention relates, first, to a device for winding longitudinally separated webs, especially paper webs, on reel cores that are mounted alternately on one and on the opposite side of a backing roll in such a way as to rotate on displaceable bearing brackets and that are forced against one generating line of the backing roll, the number of cores being equal to the number of webs and the device being equipped with means for removing the finished reels and with knives for separating the web longitudinally and transversely and, second, to a method of changing the finished reels and empty cores in such a device.

Generic machines for winding longitudinally separated webs are known, from U.S. Pat. 3,332,636 for example.

SUMMARY OF THE INVENTION

The present invention is intended to shorten the time needed to change the finished reels and cores and hence to decrease idle time.

The object of the invention is a device equipped with means that allow the finished reels and empty cores to be changed automatically in a shorter time than has hitherto been possible.

This object is attained in accordance with the invention in a device of the aforesaid type with an automatic core inserter and an adhesive applicator.

A backing roll, which is preferably a suctioning roll, suctions up longitudinally separated webs when winding is complete. Once the finished reels have been pivoted off, a transverse-separation device pivots forward and separates the individual webs. The transverse-separation device consists preferably of a single transverse knife that extends over the total axial length of the backing roll and can be pivoted around its axis or alternatively of two transverse knives positioned away from the surface of the backing roll at approximately opposite peripheral sections of it, in which case each of the two knives also extends over the total axial length of the backing roll and can be pivoted around its axis. In the latter case the longitudinally separated webs can also be transversely separated in such a way that their ends, which are of about the same length, can be kept relatively short and rapidly applied against and glued to the finished rolls in the removal position.

The new initial web lengths created by separating the longitudinally separated webs transversely are forced against the suctioning backing roll and fresh cores, once they have been conveyed into the desired receiving position, are automatically shifted into the winding position, tightened into winding bearings with tensioning heads, and forced against the backing roll.

The adhesive applicator in accordance with the invention applies traces of glue to either the initial length of each web or to the outside of the empty core. The webs are glued to the cores as rotation continues.

Automating the insertion of the cores in conjunction with the adhesive applicator results in a considerable decrease in idle time while the finished reels and empty cores are being changed.

The web is separated by the transverse knife while the finished roll is being taken away. Separation is promoted in one embodiment of the device in accordance with the invention wherein clamping strips are associated with the transverse knives to clamp the new initial web lengths created by transversely separating the longitudinally separated webs against the surface of the backing roll. The web is only clamped against the surface of the backing roll until separation is complete, at which time the transverse knife pivots back with the clamping strip into the starting position.

In another preferred embodiment of the device in accordance with the invention lifts that raise the empty cores are attached to bearing brackets. When the bearing brackets are transversely displaced into the particular positioned desired, which is dictated by the width of the longitudinally separated webs, the lifts attached to the brackets can travel along with them. This design makes it unnecessary to realign the lift with the brackets once they have been displaced.

In another preferred embodiment of the device in accordance with the invention a conveyer is positioned under the backing roll and adjustable stops that can be moved into the path of conveyance are positioned at each core-insertion position. The stops are also attached in a practical way to the bearing brackets and can be displaced along with them into another position The empty cores are supplied one after another in a direction that parallels their axis and that of the backing roll. The first core to be supplied will accordingly first strike against the last stop in the path of conveyance. Once the first core to be supplied has passed, the stop for the next core moves into the path of conveyance and retains the core in its own particular reception position, while the conveyer, which can be a belt, plate, or chain conveyer, continues to travel until the last empty core arrives in its own particular reception position. The empty cores are supplied in two parallel positions underneath the backing roll.

Some preferred embodiments of the invention will now be described with reference to the accompanying drawings, wherein

Figure 1:
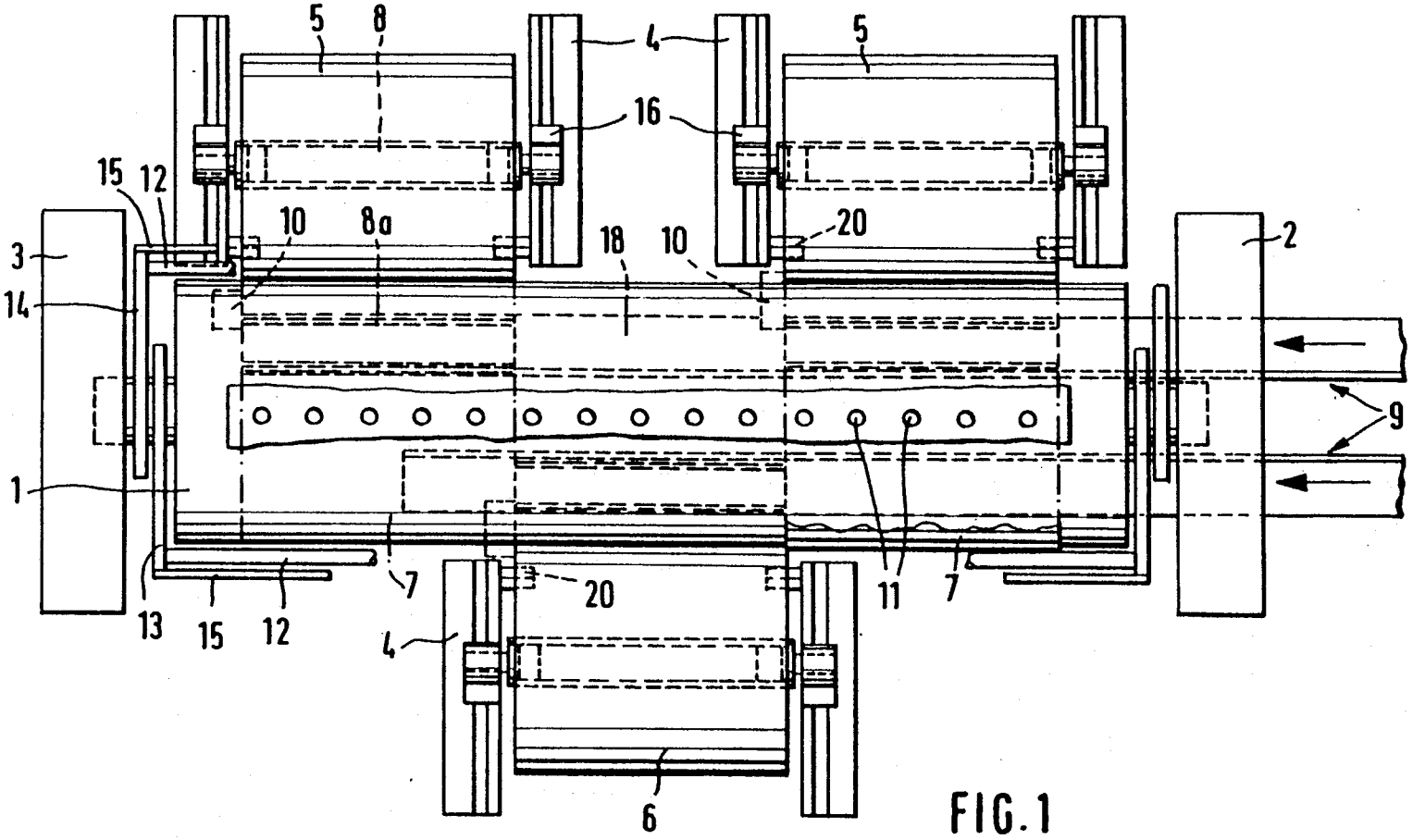
FIG. 1 is a schematic top view of a machine for winding longitudinally separated webs.

The top view in FIG. 1 shows a backing roll 1 that is mounted by means of journals in such a way as to rotate in housing frames 2 and 3.

Finished rolls 5 and 6 are mounted in such a way as to rotate in winding bearings 16 on bearing brackets 4 parallel to the length of backing roll 1 alternately on one and on the opposite side. Winding bearings 16 slide along bearing brackets 4. Above winding bearings 16, finished rolls 5 and 6 are forced against the surface of backing roll 1 in such a way that they will revolve along with it. Finished rolls 5 and 6 are created by winding a longitudinally separated web 7, separated by blades 22 shown in FIG. 2 onto empty cores 8. Bearing brackets 4 can be displaced parallel to the axis of backing roll 1 to adjust to the various width of the subsidiary webs that result from longitudinally separating the initial web.

Fresh empty cores 8*a* stand ready under backing roll 1. Cores 8*a* are supplied on conveyer 9 on two parallel paths parallel to the axis of backing roll 1 to the reception position. As illustrated in FIG. 1, stops 10 on bearing bracket 4 retain each fresh empty core 8*a* in its own particular reception position on conveyer 9.

How the finished reels and empty cores are changed will now be described with reference to FIGS. 2 through 6. The embodiments illustrated in FIGS. 2 and 3 and in FIGS. 4 through 6 differ only in that separation is carried out in the former embodiment with only a single transverse knife 15 that transversely separates the longitudinally separated web groups positioned on each side of backing roll 1 one after another, whereas separation is carried out simultaneously or almost simultaneously in the latter by two transverse knives 15 positioned around and away from the surface of backing roll 1.

Figure 4:
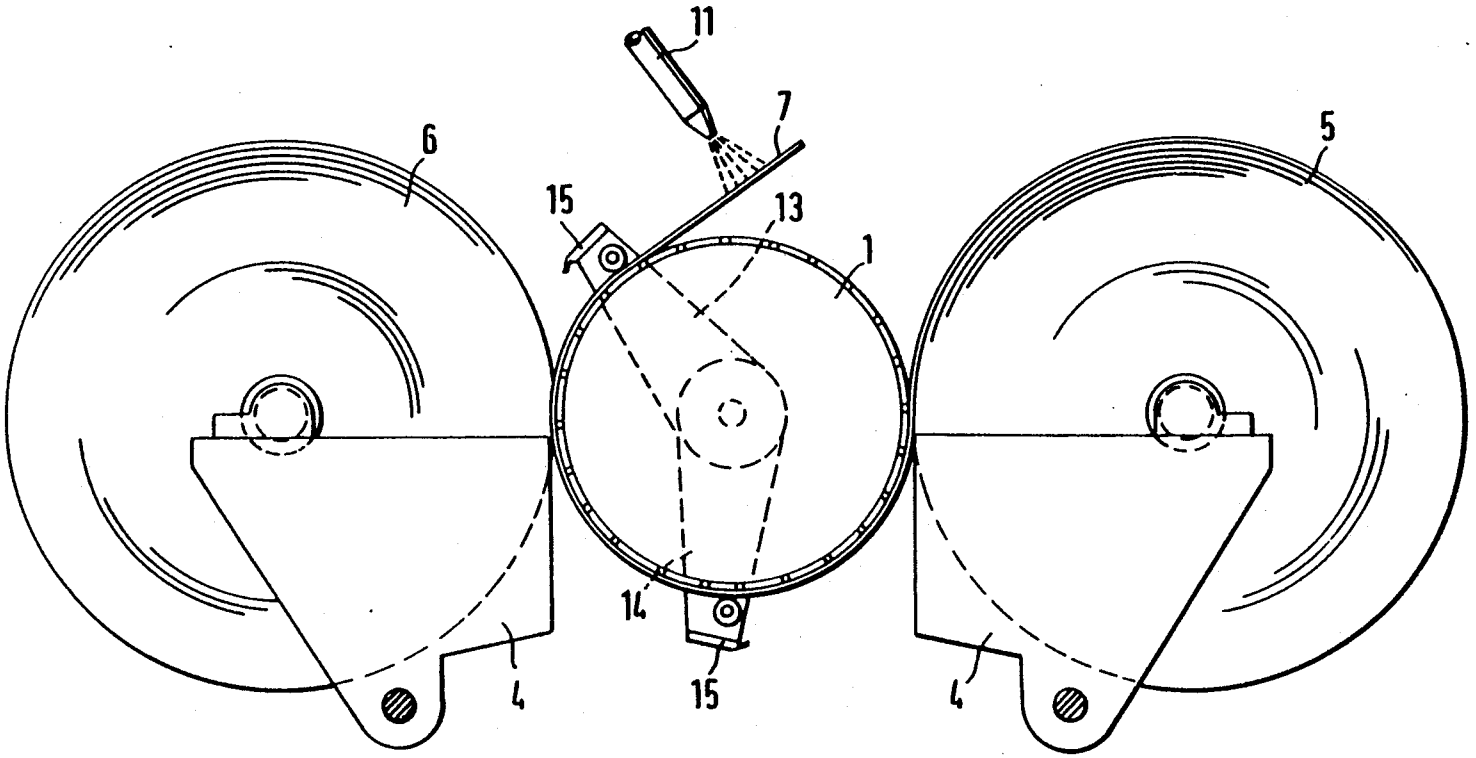
FIG. 4 is a side view of another embodiment of the device in accordance with the invention that has two transverse knives, the winding machine being shown in the winding position.

When the winding machine is in the position illustrated in FIG. 4, in which rolls 5 and 6 have been completely wound, an adhesive applicator 11 with several nozzles sprays glue onto longitudinally separated web 7.

Figure 2:
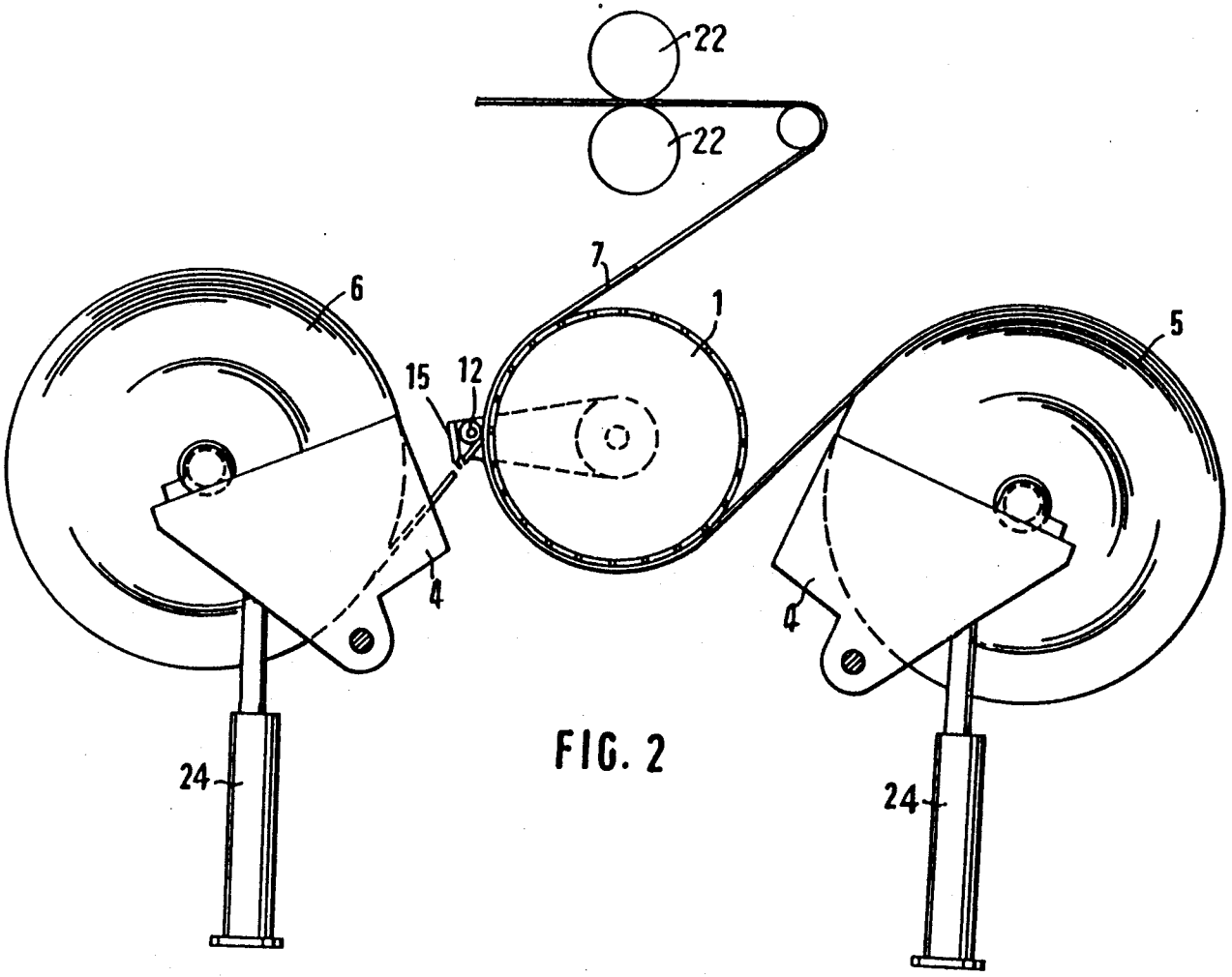
FIG. 2 is a side view of one embodiment of the device in accordance with the invention and illustrates in conjunction with FIG. 3 the separation process.
Figure 3:
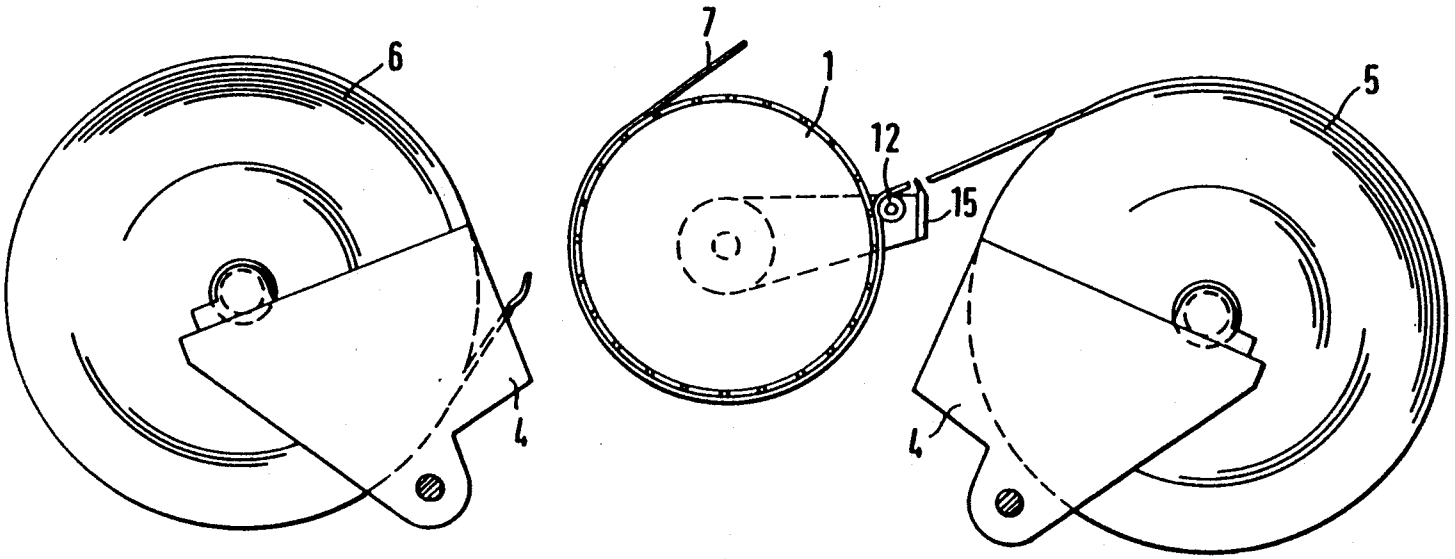
Figure 5:
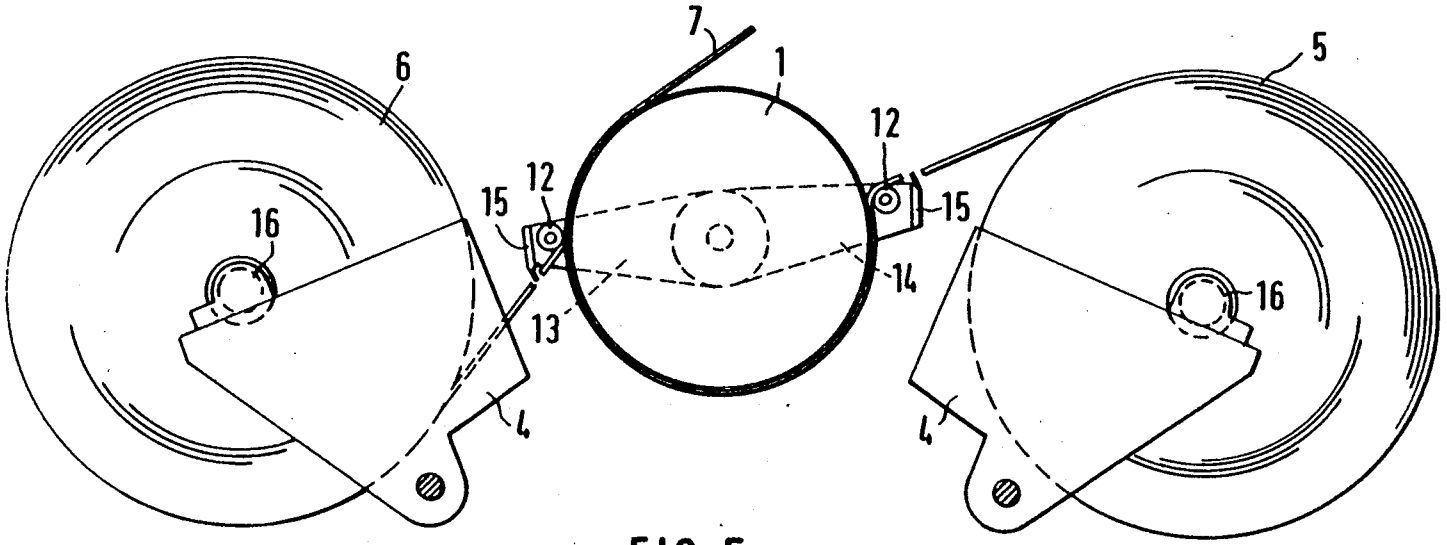
FIG. 5 illustrates how the longitudinally separated webs are separated transversely.
Figure 6:
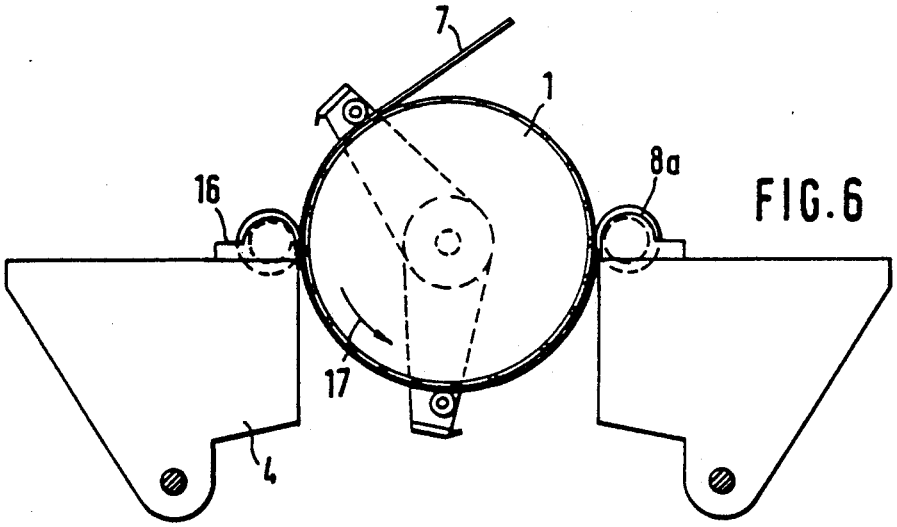
FIG. 6 illustrates the initiation of winding.

Finished rolls 5 and 6 are then lowered into the position illustrated in FIG. 5 by tipping bearing brackets 4 with drive mechanism 24 shown in FIG. 2, whereupon the rolls are removed. Clamping strips 12 force longitudinally separated web 7 against backing roll 1, which is a suction roll by pivoting levers 13 and 14 around the axis of backing roll 1 at its ends. Clamping strips 12 and transverse knife 15, which is a wire or strap with a jagged cutting edge if necessary that extends over the whole axial length of backing roll 1, are what separate the webs and are mounted in levers 13 and 14. The incision is positioned midway through the glued section of the webs. To prevent transverse knife 15 from getting clogged with glue the application of glue is briefly interrupted to leave an unglued section with the cut extending through it between two glued sections. The end of the web that glue has been applied to is glued to the surface of finished rolls 5 and 6, with the application of glue to the initial section of a web serving to attach it to a fresh winding core 8*a*.

The new initial web sections created by transverse separation will adhere as the result of partial vacuum to suctioning backing roll 1 once levers 13 and 14 have been pivoted back into the starting position (FIG. 4).

Bearing brackets 4 can be pivoted back into their operating position (FIG. 6) once finished rolls 5 and 6 have been removed. Fresh winding cores 8*a* have in the meantime been lifted out of the reception position (FIG. 1) into the winding position (FIG. 6) and taken over by the tensioning heads on winding bearings 16, which are shifted to force fresh winding cores 8*a* against backing roll 1 with variable pressure.

As backing roll 1 continues to rotate in the direction indicated by arrow 17, the glued initial sections of longitudinally separated web 7 are glued to fresh winding cores 8*a*, onto which the web supplied over backing roll 1 is increasingly wound.

Figure 7:
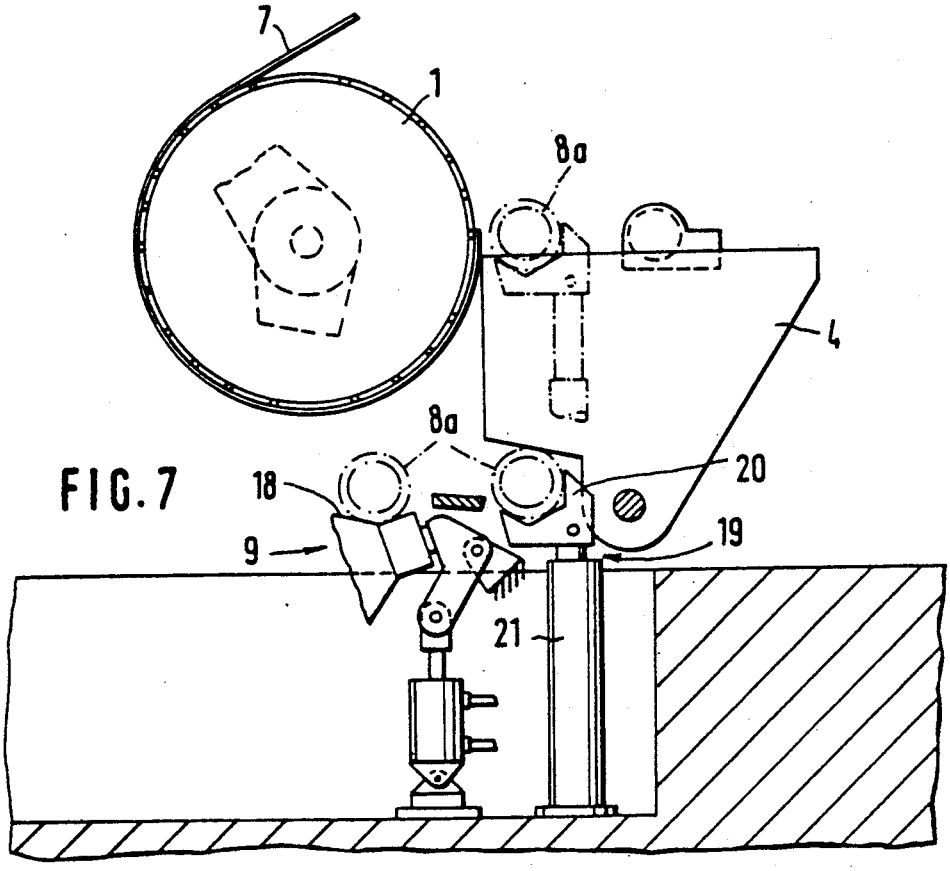
FIG. 7 is a side view of the conveyer for the empty cores and of the lift on the bearing bracket.

FIG. 7 illustrates the design and operation of the core-inserting device, which comprises, first a conveyer 9 positioned parallel below backing roll 1 and, second, a lift 19.

Conveyer 9, which is a belt, plate, or chain conveyer 18, supplies fresh winding cores 8*a* one after another parallel to the axis of backing roll 1 and with their axes parallel to the direction of conveyance. Each fresh winding core 8*a* is retained in its particular reception position as described with reference to FIG. 1 by movable stops 10 in their path of conveyance. Fresh winding cores 8*a* are transferred from conveyer 9, by tipping it to one side for example and by means of guide plates if necessary, into the receiver 20 of lift 19. Receiver 20 can be raised along with fresh winding cores 8*a* by a mechanical, pneumatic, or hydraulic drive mechanism 21 into the position indicated by the dot-and-dash lines in which they then are seized and tensioned by the tensioning heads of winding bearings 16.

It is understood that the specification and examples are illustrative but not limitative of the present invention and that other embodiments within the spirit and scope of the invention will suggest themselves to those skilled in the art.

I claim:

1. A device for winding longitudinally operated webs on reel cores comprising a backing roll, a plurality of reel cores disposed alternately on diametrically opposite sides of the backing roll with the number of cores being equal to the number of webs, means mounting each reel core for rotating about an independent axis of rotation comprising displaceable horizontal bearing brackets to force the core reels against one generating line on each side of the backing roll, means for removing the finished reels, means for separating the webs longitudinally and transversely to define a cut area, an automatic core inserter including conveyer means positioned under the backing roll for conveying the cores parallel to the longitudinal axis of the backing roll and means for stopping the cores under the bearing brackets, and means for applying glue to the vicinity of the cut area of the longitudinally separated web.

2. A device according to claim 1, wherein the means for separating the web transversely comprises a knife which extends over the total axial length of the backing roll and is mounted for pivoting around the axis of the backing roll.

3. A device according to claim 1, wherein the means for separating the web transversely comprises two knives positioned away from the surface of the backing roll at approximately opposite peripheral sections of it, each of the two knives extending over the total axial length of the backing roll and being mounted for pivoting around the axis of the backing roll.

4. A device according to claim 2, including clamping strips associated with the transverse separating means to clamp against the surface of the backing roll the new initial web lengths created by transversely separating the longitudinally separated webs.

5. A device according to claim 1, wherein the automatic core inserter includes lifts that raise the empty cores that attach to the bearing brackets.

6. A method of changing the finished reels and empty cores in a winding machine comprising: longitudinally separating webs and winding same around independent axes of rotation alternately on opposite sides of a backing roll on cores that are forced against the surface of the backing roll, supporting the cores on bearing brackets, transversely separating the longitudinally separated webs in the vicinity of the backing roll at points diametrically opposite its axis while removing the finished rolls from the winding machine, the points at which the webs are separated being selected to produce short terminal web sections of approximately equal length, automatically supplying fresh empty cores by conveying the cores parallel to the longitudinal axis of the backing roll and stopping the cores under the bearing brackets, and forcing the supplied fresh empty cores independently against the surface of the backing roll.

* * * * *